US005333557A

United States Patent [19]

Eickhoff

[11] Patent Number: 5,333,557

[45] Date of Patent: Aug. 2, 1994

[54] SIDE RAIL CONNECTOR FOR A PLATFORM ASSEMBLY

[75] Inventor: Jon H. Eickhoff, Kalamazoo, Mich.

[73] Assignee: Ronningen Research & Development Company, Vicksburg, Mich.

[21] Appl. No.: 952,045

[22] Filed: Sep. 28, 1992

[51] Int. Cl.[5] ..... A47B 96/00; B61G 5/00; E04G 7/20

[52] U.S. Cl. ..... 108/65; 405/218; 403/293

[58] Field of Search ..... 108/63, 64, 65, 59, 108/111, 114; 403/195.1, 196, 200, 292, 293, 296; 405/218, 221, 226; 114/27, 28; 312/111; 248/188, 188.8

[56] References Cited

U.S. PATENT DOCUMENTS

| | | | |
|---|---|---|---|
| 2,675,287 | 4/1954 | Sitler | 108/64 X |
| 3,703,870 | 11/1972 | Walton | 108/64 X |
| 4,150,630 | 4/1979 | Pokorny et al. | 108/64 |
| 4,158,335 | 6/1979 | Belcastro et al. | 108/64 |
| 4,675,929 | 6/1987 | Santo | 108/64 X |
| 4,852,509 | 8/1989 | Fransen et al. | 405/218 X |
| 4,969,777 | 11/1990 | Eickhoff | 405/218 |
| 5,156,493 | 10/1992 | Johnson | 405/218 X |

*Primary Examiner*—Clifford D. Crowder

*Assistant Examiner*—Ismael Izaguirre

*Attorney, Agent, or Firm*—Flynn, Thiel, Boutell & Tanis

[57] ABSTRACT

A combination of a side rail of a platform assembly and a bracket member therefor. The side rail has an elongated sidewardly opening recess. The recess also opens outwardly at one end thereof. The recess includes a bottom wall and a plurality of upstanding sidewalls. An end of the recess remote from the aforesaid one end includes an enlargement. The bracket member has at one end thereof an enlarged segment and at an other end thereof an attachment structure for facilitating an attachment of the bracket member to another object. The enlargement and the attachment structure are connected by a central section. Edge facing surfaces of the central section of the bracket conform to and oppose the sidewalls of the recess between the enlargement and one end of the side rail. An embossment is upstanding from the bottom wall of the recess and has a first hole therethrough. A pocket is provided in the bracket member and receives therein the aforesaid embossment. The pocket has a second hole in the bottom wall thereof. A fastening element is received in the aligned first and second holes for drawing the bracket member into the recess to cause a locking fit of the bracket member in the recess and to the side rail.

7 Claims, 3 Drawing Sheets

SIDE RAIL CONNECTOR FOR A PLATFORM ASSEMBLY

FIELD OF THE INVENTION

This invention relates to a combination of a side rail of a platform assembly and a bracket member therefor and, more particularly, to a side rail connection for securing a pair of end-to-end oriented side rails of a platform assembly together.

BACKGROUND OF THE INVENTION

This invention relates to an improvement in the subject matter disclosed in my U.S. Pat. No. 4,969,777. In the assembly of the platform shown therein, the side rails were joined end to end by a pair of fishplates which straddle the end-to-end positioned side rails. A plurality of fastening elements extend through aligned holes in the straddling fishplates and the side rails so as to effect a securement of the fishplates to the side rails to thereby result in end-to-end connected side rail assemblies. While this structure for effecting a securement of the side rails together has heretofore been acceptable, it has been, however, somewhat problematic in that numerous pieces are required in order to effect the assembly and when it is desired to connect other objects to the end of a side rail, the fishplates have not been amenable to such connection. Accordingly, it is desirable to provide a structure which will effect a securement of a pair of end-to--end side rails together as well as to allow the connection of another object to the end of a particular side rail.

Accordingly, it is an object of this invention to provide a combination side rail and bracket member which are capable of being fixably connected to one another for providing the requisite strength characteristic to facilitate connection of the side rail to another object solely through the bracket member.

It is a further object of this invention to provide a combination side rail and bracket member, as aforesaid, wherein a contoured recess is provided in a side facing surface of the side rail and the bracket member is of a shape that conforms to the recess.

It is a further object of this invention to provide a combination side rail and bracket member, as aforesaid, wherein only a single bracket member is required in order to effect an end-to-end connection of a pair of side rails in a platform assembly.

It is a further object of this invention to provide a combination side rail and bracket member, as aforesaid, wherein the peripheral edge surface on the bracket member conforms to the sidewall surfaces of the recess in the side rail so that a face-to-face contact occurs between them to facilitate a rigid connection of the bracket member to the side rail when a fastening element is utilized to draw the bracket member into the recess.

SUMMARY OF THE INVENTION

The objects and purposes of this invention have been met by providing a combination of a side rail of a platform assembly and a bracket member therefor, the side rail having an elongated sidewardly opening recess in a side facing surface thereof adjacent at least one end of the side rail. The recess also opens outwardly at an end surface at the aforesaid one end. The recess includes a bottom wall surface and a plurality of opposing sidewall surfaces upstanding from the bottom wall surface at a first angle relative to the bottom wall surface that is greater than 90°. An end of the recess remote from the aforesaid one end includes an enlargement of a width dimension of the recess in a direction transverse of a longitudinal axis of the elongated recess so that at least a sidewall surface section faces away from the aforesaid one end. The opposing sidewall surfaces between the enlargement and the one end increases in spacing along a length of the recess from the enlargement toward the aforesaid one end. The bracket member has at one end thereof an enlargement and at an other end thereof an attachment structure for facilitating an attachment of the bracket member to another object. The enlargement and the attachment structure are connected by a central section. The bracket member has at least one side facing surface extending parallel to the bottom wall surface of the recess and a plurality of edge facing surfaces extending at a second angle relative to the side facing surface that is generally equal to the first angle. Edge facing surfaces of the central section conform to and oppose the opposing sidewall surfaces between the enlargement and one end of the side rail. The enlarged end has an edge surface section that conforms to and opposes the sidewall surface section in the enlargement. An embossment is upstanding from the bottom wall surface and has a hole therethrough. A pocket is provided in the bracket member and receives therein the aforesaid embossment. The pocket has a hole in the bottom wall thereof. A fastening element is received in the aligned holes for drawing the bracket member into the recess to bring the peripheral surfaces on the bracket member into face-to-face engagement with the sidewall surfaces of the recess as well as a side facing surface of the bracket member into engagement with the bottom wall surface on the side rail to cause a locking fit of the bracket member in the recess and to the side rail, the attachment structure extending beyond one end of the side rail ready for attachment to another object.

BRIEF DESCRIPTION OF THE DRAWINGS

Other objects and purposes of the invention will be apparent to persons having ordinary skill in this art and upon reading the following specification with reference to the accompanying drawings, in which.

DETAILED DESCRIPTION

Figure 1:
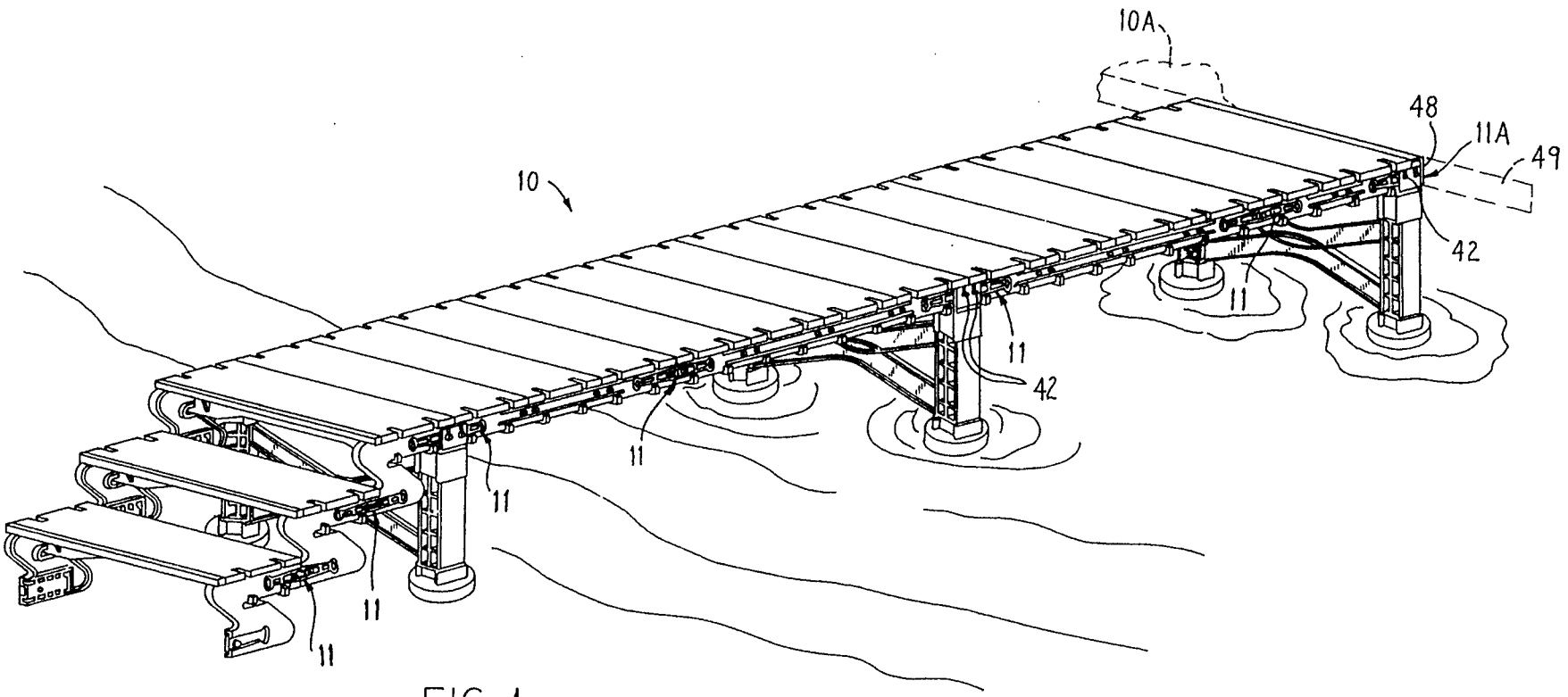
FIG. 1 is a perspective view of a platform assembly having a side rail and bracket member construction embodying my new invention.

The platform assembly 10 illustrated in FIG. 1 is virtually identical to the platform assembly shown in FIG. 1 of my U.S. Pat. No. 4,969,777. Accordingly, reference to U.S. Pat. No. 4,969,777 is incorporated herein by reference. The component details of the platform assembly 10 are also disclosed in my earlier issued U.S. Pat. No. 4,971,478 and U.S. Pat. Nos. D 322,131, D 322,132, D 322,134 and D 326,159, and reference thereto is also incorporated herein by reference.

Figure 2:
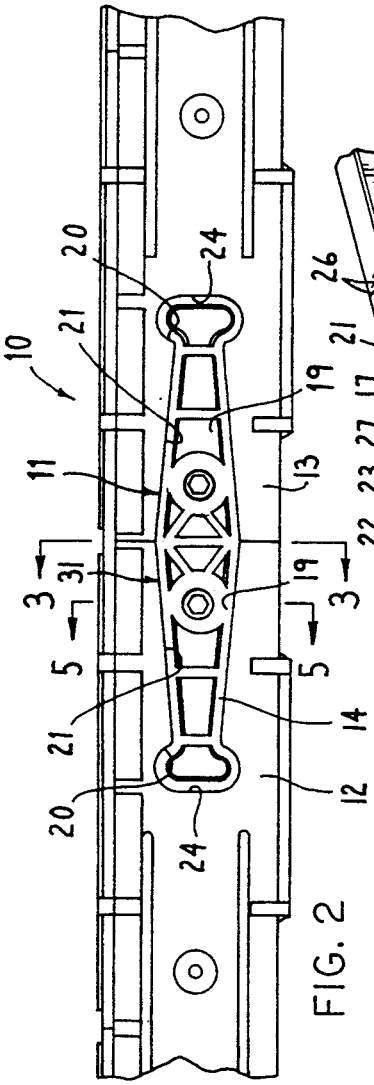
FIG. 2 is an enlarged side view of the side rail and bracket member connection embodying my invention.
Figure 3:
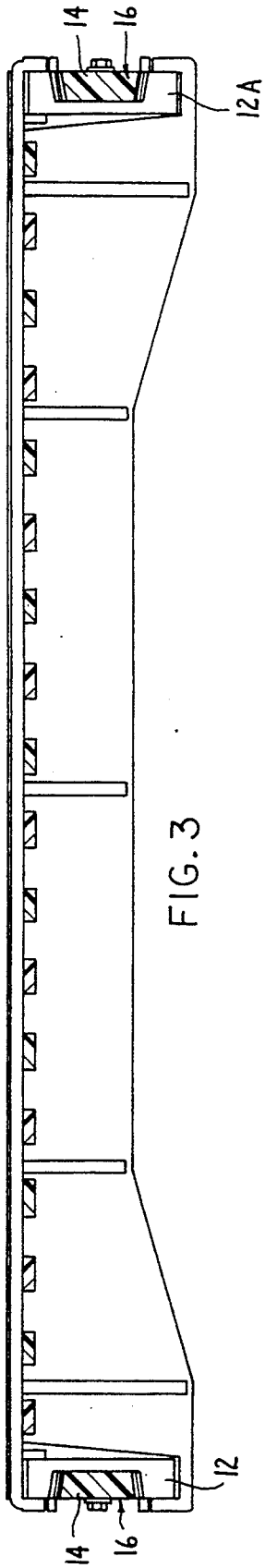
FIG. 3 is a sectional view taken along the line III—III of FIG. 2.

Since this invention relates to a side rail and bracket member connection 11, the following discussion will pertain only to the invention, namely, the aforesaid connection 11. Referring now to FIG. 2, the platform assembly 10 includes a pair of side rails 12 and 13 which are to be joined together by a bracket member 14. Since, as shown in FIG. 3, the platform assembly 10 includes a pair of parallel side rails, the second side rail has been identified by the same reference numeral 12 but has the suffix "A" added thereto.

Figure 5:
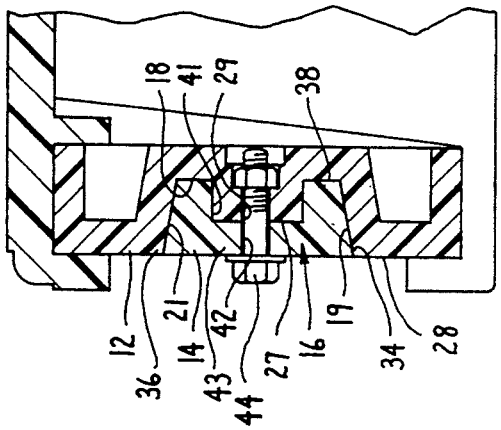
FIG. 5 is a sectional view taken along the line V—V of FIG. 2.
Figure 4:
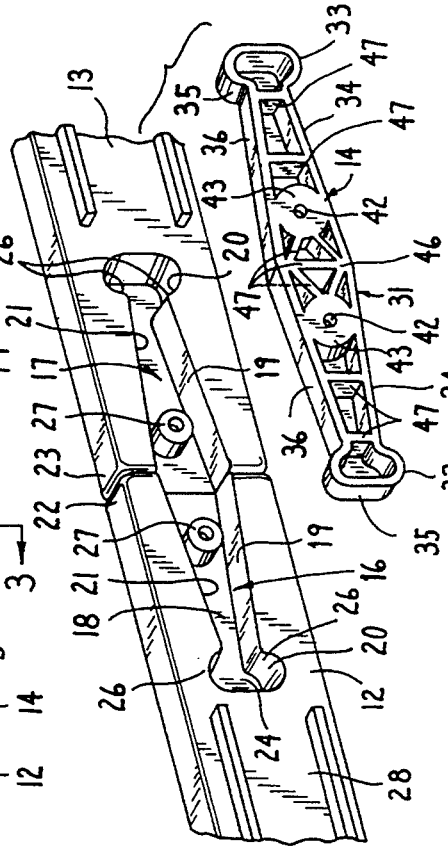
FIG. 4 is an exploded isometric of the side rail and bracket member assembly.

The side rails 12 and 13 are made of a moldable synthetic resin material, preferably a recycled plastics material. Each side rail 12 and 13 has a side facing recess 16 and 17, respectively, therein at the mutually adjacent ends. The recesses 16 and 17, as best illustrated in FIGS. 2 and 4, are a mirror image of one another, and each consists of a bottom wall 18 and a plurality of sidewall surfaces 19, 20 and 21. Each of the sidewall surfaces 19, 20 and 21 is inclined to the bottom wall surface 18 at an angle that is greater than 90° as illustrated in FIG. 5. More specifically, the outline of each recess 16 and 17 at the side facing surface of each side rail 12 and 13, respectively, is of a larger dimension than the corresponding dimension adjacent the bottom surface 18 of the respective recess.

An end of each recess 16, 17 remote from the adjoined ends 22 and 23 of the side rails 12 and 13, respectively, includes an enlarged recess portion 24 having a width dimension taken in a direction transverse of a longitudinal axis of the recess 16, 17 that is greater than the mutually adjacent and contiguous part of the recess so that sidewall surface sections 26 are provided which face away from the adjoined ends 22 and 23. Further, the sidewall surfaces 20 in the enlargement 24 are also inclined to the bottom wall to the same extent as are the sidewall surfaces 19 and 21 as illustrated in FIG. 5. In this particular embodiment, the enlargement 24 is generally of an elliptical configuration as shown in FIGS. 2 and 4. The side surfaces 19 and 21 diverge away from one another from the enlargement 24 toward a respective adjoined end 22, 23.

An embossment 27 is provided on the bottom wall 18 and upstands therefrom to a height recessed from a side facing surface 28 of the side rail. A hole 29 extends through the embossment 27 as illustrated in FIG. 5. The embossment 27 is oriented between the aforesaid adjoined ends 22, 23 and the enlargement 24.

When the side rails 12 and 13 are joined so that the ends 22, 23 are end-to-end as illustrated in FIGS. 2 and 4, the recesses 16 and 17 become a mirror image of one another and form a single elongated side facing recess having a shape somewhat similar to that of a dog bone.

The entire volume of the single elongated side facing recess 16, 17 is occupied by the bracket member 14, which single recess 16, 17 also has the appearance of a dog bone. That is, the bracket member 14 has a central section 31 and two enlarged end sections 32, 33. The enlarged end sections 32 and 33 conform in shape to the enlargements 24 in the recesses 16 and 17. Further, the peripheral edge facing surfaces 34, 35 and 36 on a left end of the bracket member 14 illustrated in FIGS. 2 and 4 conform to both angle and shape of the sidewall surfaces 19, 20 and 21, respectively. Since the recesses 16 and 17 are a mirror image of one another, the left half of the bracket member illustrated in FIGS. 2 and 4 is a mirror image of the right end thereof and, accordingly, the same reference numerals 34, 35 and 36 have been utilized to designate the corresponding surfaces. The side facing surface 38 of the bracket member 14 is parallel to and directly opposes the bottom wall surface 18 of the respective recesses 16, 17.

The bracket 14 also has a pair of pockets 41, one of the pockets 41 being illustrated in FIG. 5. Each pocket is of a size adapted to loosely receive therein the aforesaid embossments 27. Each pocket 41 has a hole 42 through the bottom wall 43 thereof.

When a pair of side rails 12 and 13 are oriented end to end as illustrated in FIG. 4, the placement of the bracket member 14 into the single elongated side facing recess 16, 17 so that the embossments 27 are received in the respective pockets 41, the holes 29 and 42 will become axially aligned for reception of a fastening element 44, here a nut and a bolt. Upon a tightening of the nut and bolt, the bracket member 14 will be drawn into the recesses 16, 17 so that the edge surfaces 34, 35 and 36 on the bracket member will come into face-to-face contact with the sidewall surfaces 19, 20 and 21, respectively, in the recesses 16 and 17. Further, the surface 46 of the bracket member 14 which faces outwardly of the recesses 16, 17 will eventually become oriented flush with the side facing surface of the side rails 12 and 13 as illustrated in FIG. 5. Since the sidewall surfaces 19, 20 and 21 of each recess 16 and 17 are angularly related to the bottom wall surface 18, and since the peripheral edges 34, 35 and 36 on both halves of the bracket member 14 are also similarly angularly inclined, the bracket member 14 functions somewhat as a wedge as the fastening element 44, when tightened, urges the bracket member into the recesses 16 and 17 so as to effect a rigid connection of the bracket member 14 to each of the side rails 12 and 13. The force of engagement between the sidewall surfaces of the recess and the peripheral edge surfaces on the bracket member 14 is so great as to require reinforcement webbing 47 when the bracket member is of a generally uniformly thick wall construction, as when the bracket member 14 is made out of a moldable synthetic resin material so as to enhance curing of the synthetic resin during molding thereof. It will also be noted that not only are the recesses 16, 17 a mirror image of one another, but that the recesses are a mirror image of one another on opposite sides of a longitudinally extending centerline through the length of each recess. That is, the upper half of each recess 16, 17 is the mirror image of the lower half thereof. Similarly, the dog bone-like bracket member 14 is also like constructed, namely, the upper half thereof is a mirror image of the lower half. As a result, a single bracket member 14 can be manufactured for use along either the left side or the right side of the platform assembly as illustrated in FIG. 1.

Figure 6:
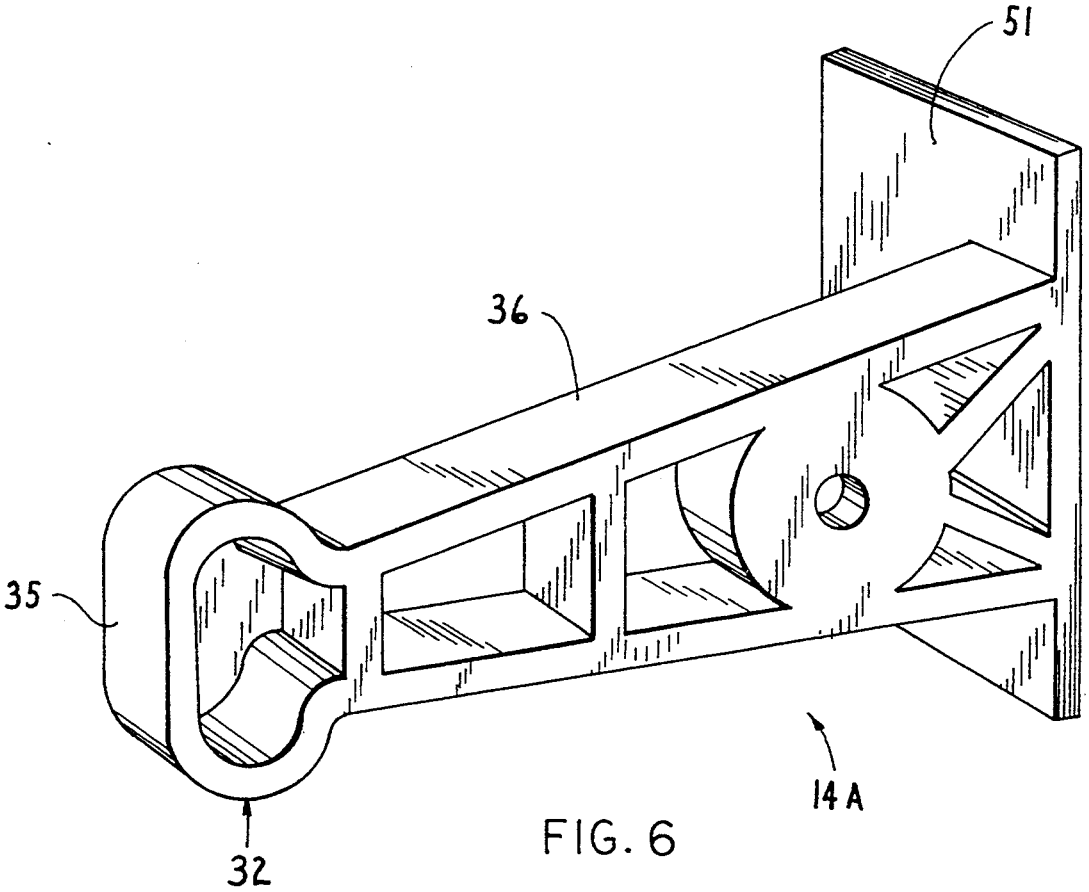
FIG. 6 is a perspective view of a modified bracket member.

In addition, the bracket member 14A located at the outboard end of the platform assembly 10 illustrated in FIGS. 1 and 6 has an attachment structure 48 thereon to facilitate attachment to another object 49, such as a right angle extending platform assembly 10A. In this particular instance, the left end of the bracket member 14 illustrated in FIG. 4 would be received in the recess 16 of the side rail 12 but that the attachment section 48 would project from the end 22 for attachment to the other object 49. In this particular embodiment, the right end of the bracket member 14 illustrated in FIG. 4 would be of a transversely extending flat plate 51 in place of the enlarged end 33.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A platform assembly comprising the following in combination:

an elongated first side rail, said first side rail comprising at least one end and an end surface thereat and a first side facing surface, means defining an elongated sidewardly opening recess in said first side facing surface adjacent said at least one end thereof, said recess comprising a bottom wall and a plurality of upstanding sidewalls, said recess also opening outwardly at said end surface, said plurality of upstanding sidewalls extending at a first angle relative to said bottom wall that is greater than 90°, an end of said recess remote from said one end including means defining an enlargement having a width dimension in a direction transverse of a longitudinal axis of said elongated recess so that at least a sidewall section in said recess faces away from said one end, said upstanding sidewalls in said recess between said enlargement to a width dimension and said one end increasing in spacing along a length of said recess from said enlargement toward said one end;

a bracket member, said bracket member comprising at least one end, said bracket member having at said one end thereof an enlarged portion and at another end thereof an attachment means for facilitating an attachment of said bracket member to an object, said enlarged portion and said attachment means being connected by a central section, said bracket member having at least one second side facing surface extending parallel to said bottom wall of said recess in said first side rail and a plurality of edge facing surfaces extending at a second angle relative to said second side facing surface that is generally equal to said first angle, said edge facing surfaces of said central section conforming to and opposing said sidewalls between said enlargement of said recess and said one end of said first side rail, said enlarged portion including an edge surface section that conforms to and opposes said sidewall section in said enlargement of said recess;

at least one embossment upstanding from said bottom wall of said recess and hang an exterior wall surface and means defining a first hole through said embossment and said bottom wall;

a pocket in said at least one second side facing surface of said bracket member, said pocket having an interior wall surface and a bottom wall and receiving therein said embossment, said exterior wall surface of said at least one embossment conforming to said interior wall surface of said pocket, said bottom wall of said pocket having means defining a second hole extending therethrough; and fastening means received in aligned first and second holes for drawing said bracket member into said recess to bring said at least one second side facing surface, said edge facing surfaces and said edge surface section of said bracket into fact-to-fact engagement with said bottom wall, said plurality of sidewalls and said sidewall section in said recess to cause a licking fit of said bracket member in said recess and to said first side rail, said attachment means extending beyond said one end of said side rail ready for attachment to the object.

2. The platform assembly according to claim 1, wherein the object is a second side rail having a second side facing recess therein identical to and mirroring said first side facing recess in said first side rail, and wherein said attachment means is a mirror image of said one end and said central section of said bracket member and is received in said second side facing recess when said second side rail is oriented end-to-end with said first side rail.

3. The platform assembly according to claim 2, wherein said first side facing recess and said second side facing recess, when joined end-to-end have a dog bone shape and, wherein said bracket member has a dog bone shape.

4. The platform assembly according to claim 1, wherein a depth dimension of said first side facing recess is equal to a thickness dimension of said bracket member whereby a surface on said bracket member facing outwardly of said recess in flush with said first side facing surface of said first side rail.

5. A side rail connection for securing a pair of end-to-end oriented side rails of a platform assembly, each side rail having commonly facing side surfaces, mutually adjacent ends and opposing end surfaces at said mutually adjacent ends, comprising:

means defining identical elongated sidewardly opening recesses in said commonly facing side surface of each side rail at said mutually adjacent ends of said side rails, said recesses also opening outwardly at said opposing end facing surfaces of said side rails so that when said opposing end surfaces abut together, said recess in each said side rail defines a single elongated side facing recess, said single elongated side facing recess including a bottom wall and a plurality of upstanding sidewalls extending at a first angle relative to said bottom wall that is greater than 90°, opposite lengthwise ends of said single elongated side facing recess both including means defining an enlargement of a width dimension in a direction transverse of a longitudinal axis of said single elongated side facing recess to define a sidewall section on each of said side rails facing away from said mutually adjacent ends, said outstanding sidewalls between said enlargement of a width dimension and said mutually adjacent ends of said side rails increasing in spacing along a length of said single elongated side facing recess from each said enlargement toward each said mutually adjacent end;

an elongated bracket member received in said single elongated side facing recess and having opposite enlarged ends connected by a central section, said bracket member having at least one side facing surface extending parallel to said bottom wall and a plurality of edge facing surfaces extending at a second angle relative to said side facing surface that is generally equal to said first angle, said edge facing surfaces of said central section conforming to and opposing said upstanding sidewalls between said enlargements of said single elongated side facing recess, said enlarged ends of said bracket member each including an edge section that conforms to and opposes said sidewall section in each enlargement of a width dimension of said single elongated side facing recess;

at least one embossment upstanding from said bottom wall on each side rail and having an exterior wall surface and means defining a first hole extending through said embossment and said bottom wall;

a pair of pockets in said at least one side facing surface of said bracket member each having a bottom wall and an interior wall surface, said pockets receiving in each thereof said embossment, said exterior wall surface of each said embossment conforming to said interior wall surface of each said pocket, said bottom wall of each said pocket having means defining a second hole extending therethrough aligned with said first hole when said embossment is received in said pocket; and fastening means received in said aligned first and second holes for drawing said bracket member into said recess to bring said at least one side facing surface, said edge facing surfaces and said edge sections of said bracket into fact-to-face engagement with said bottom wall, said plurality of sidewalls and said sidewall sections in said single elongated side facing recess to cause a locking fit of said bracket member in said single elongated side facing recess and to each said side rail to connect said mutually adjacent ends together solely through a single side bracket member.

6. The side rail connection according to claim 5, wherein said bracket member is made of a moldable synthetic resin.

7. The side rail connection according to claim 5, wherein said single side facing recess has a dog bone shape and, wherein said bracket member also has a dog bone shape.

* * * * *

UNITED STATES PATENT AND TRADEMARK OFFICE

CERTIFICATE OF CORRECTION

PATENT NO. : 5 333 557

DATED : August 2, 1994

INVENTOR(S) : Jon H. EICKHOFF

It is certified that error appears in the above-indentified patent and that said Letters Patent is hereby corrected as shown below:

Column 5, line 23; change "enlargement to a" to ---enlargement of a---.

line 47; change "and hang an" to ---and having an---.

line 62; change "fact-to-fact" to ---face-to-face---.

line 65; change "licking fit" to ---locking fit---.

Column 6, line 19; change "in flush" to ---is flush---.

Column 8, line 1; change "fact-to-face" to ---face-to-face---.

Column 8, line 8; change "side bracket member." to ---said bracket member.---.

Signed and Sealed this

Twenty-second Day of November, 1994

*Attest:*

Bruce Lehman

BRUCE LEHMAN

*Attesting Officer*

*Commissioner of Patents and Trademarks*